US009068378B2

(12) United States Patent
Milani et al.

(10) Patent No.: US 9,068,378 B2
(45) Date of Patent: Jun. 30, 2015

(54) CLOSURE SYSTEM FOR A DRAWER CABINET

(71) Applicant: FAMI S.R.L., Rosa' (Vicenza) (IT)

(72) Inventors: Luca Milani, Rossano Veneto (IT); Giuseppe Tosin, Bassano del Grappa (IT)

(73) Assignee: FAMI S.R.L., Rosá (IT)

( * ) Notice: Subject to any disclaimer, the term of this patent is extended or adjusted under 35 U.S.C. 154(b) by 0 days.

(21) Appl. No.: 14/288,039

(22) Filed: May 27, 2014

(65) Prior Publication Data

US 2014/0354120 A1 Dec. 4, 2014

(30) Foreign Application Priority Data

May 28, 2013 (IT) ..... MO2013A0151

(51) Int. Cl.

| | |
|---|---|
| ***E05B 65/46*** | (2006.01) |
| ***E05B 43/00*** | (2006.01) |
| ***E05B 47/06*** | (2006.01) |
| ***E05B 13/10*** | (2006.01) |
| *E05B 53/00* | (2006.01) |
| *E05B 47/00* | (2006.01) |

(52) U.S. Cl.

CPC ..... *E05B 65/462* (2013.01); *E05B 65/464* (2013.01); *E05B 43/00* (2013.01); *E05B 47/0603* (2013.01); *E05B 53/005* (2013.01); *E05B 13/105* (2013.01); *E05B 2047/0094* (2013.01)

(58) Field of Classification Search

CPC ... E05B 65/462; E05B 65/463; E05B 65/464; E05B 65/465; E05B 65/466; E05B 65/468; E05B 65/003

USPC ..... 312/216–219, 221

See application file for complete search history.

(56) References Cited

U.S. PATENT DOCUMENTS

| | | | | |
|---|---|---|---|---|
| 4,804,876 | A * | 2/1989 | Lannert et al. | 312/221 |
| 2003/0102784 | A1 | 6/2003 | Friar et al. | |
| 2003/0127953 | A1* | 7/2003 | Muller | 312/217 |
| 2005/0199022 | A1 | 9/2005 | Friar et al. | |
| 2005/0210933 | A1* | 9/2005 | Wen | 70/78 |
| 2006/0066187 | A1* | 3/2006 | Chang | 312/219 |
| 2006/0125357 | A1* | 6/2006 | Ludwig et al. | 312/221 |

(Continued)

FOREIGN PATENT DOCUMENTS

| | | |
|---|---|---|
| CA | 2 531 914 A1 | 10/2006 |
| DE | 203 15 217 U1 | 12/2003 |

(Continued)

*Primary Examiner* — Hanh V Tran

(74) *Attorney, Agent, or Firm* — Pearne & Gordon LLP

(57) ABSTRACT

A closure system for drawer cabinets, comprising locking means (2) with stacked cams (4) and that can be configured in at least a releasing position, in which it enables the opening of a drawer (102), and a locking position, in which it prevents the opening of the drawers (102); activation means (9) that can be activated by means of the command of an operator and that is active on said locking means (2) for moving the locking means (2) between said locking (closed) and releasing (open) positions; and enabling means (15) designed for enabling and disabling movement of the locking means (2) between the locking and releasing positions. The activation means (9) is configured in such a manner as to bring itself automatically from the open position to the closed position within a pre-established interval of time, following release of a command for opening the activation means (9) by the operator.

18 Claims, 17 Drawing Sheets

(56) References Cited

U.S. PATENT DOCUMENTS

| | | | | |
|---|---|---|---|---|
| 2006/0138912 | A1* | 6/2006 | Chen et al. | 312/217 |
| 2006/0279182 | A1* | 12/2006 | Chi Ming | 312/219 |
| 2008/0157642 | A1* | 7/2008 | Liu | 312/334.1 |
| 2008/0279490 | A1* | 11/2008 | Holcomb | 384/42 |
| 2010/0171399 | A1* | 7/2010 | Zheng | 312/216 |
| 2010/0253193 | A1* | 10/2010 | Green | 312/333 |
| 2011/0005283 | A1* | 1/2011 | Sevillano Gil | 70/85 |
| 2011/0316397 | A1* | 12/2011 | Sabelli | 312/216 |
| 2012/0242201 | A1 | 9/2012 | Fulterer | |

FOREIGN PATENT DOCUMENTS

| | | | |
|---|---|---|---|
| DE | 20 2008 001 646 | U1 | 5/2008 |
| DE | 20 2008 006 209 | U1 | 9/2008 |
| GB | 2 220 026 | A | 12/1989 |

* cited by examiner

CLOSURE SYSTEM FOR A DRAWER CABINET

The object of the present invention is a closure system for drawer cabinets, as well as a drawer cabinet equipped with this closure system. More specifically, the invention particularly applies to drawer cabinets of a movable type and thus provided with caster wheels or mounted on vehicles, and that are subject to accidental opening owing to inertia during movement.

There are known drawer cabinets of the type having a plurality of drawers that can be opened and closed in a manner controlled by an operator by means of key switches. In one solution, each drawer has a respective lock that can be opened or closed to enable the opening of a drawer in a regulated manner. In a different solution, all the drawers are managed by a single lock that commands the release or locking of the drawers by means of a mechanism with overlapping cams that allows for the opening of only one drawer at a time. Mechanisms of this type are known for example from US2012/0242201, in which a single key can be switched between an open position, in which it allows for the lifting of a cam so as to enable the opening of a drawer, and a closed position, in which it prevents the lifting of a cam sufficient to allow for the opening of a drawer.

The Applicant has found that the solutions described above have several drawbacks.

As regards both solutions described hereinabove, it has been found that a user may unintentionally forget to reclose the lock after having opened the lock with the key and having had access to the drawers, thus leaving the drawer cabinet exposed to possible accidental opening of a drawer when the cabinet is moved or when the vehicle on which the cabinet is installed is moving. This highly undesirable consequence can cause the cabinet to tip over or cause accidents involving personnel in the vicinity of the cabinet.

With reference to the solution with locks on each drawer, there is a problem concerning the visibility of these locks that negatively affect the overall aesthetic appearance of the cabinet, as well as possible inconvenience relating to the use of a number of different keys.

There are also existing solutions in which each drawer is equipped with a respective manual opening lever that may or may not be associated with a respective shared lock. However, these solutions entail greater complexity in terms of the structure and assembly, as relates to the need to provide an opening lever on each drawer. Therefore, the technical task of the present invention is to make available a closure system for drawer cabinets that overcomes the drawbacks of the prior art described hereinabove.

In particular, the aim of the present invention is to make available a closure system for drawer cabinets that offers a high level of safety for use particularly on drawer cabinets of a movable type or mounted on vehicles or boats.

Making available a closure system for drawer cabinets that is highly practical to use is also an aim of the present invention.

Making available a closure system for drawer cabinets that is highly simple in construction and very easy to assemble is a further aim of the invention. A drawer cabinet equipped with said closure system also constitutes the object of the present invention.

The technical characteristics of the invention, according to the above-mentioned aim, are clearly observable in the contents of the claims appearing herein below, and the advantages of the invention will prove to be more apparent in the detailed description that follows, provided with reference to the attached drawings representing an embodiment that is solely an approximate and non-limiting example, in which:

Figure 1:
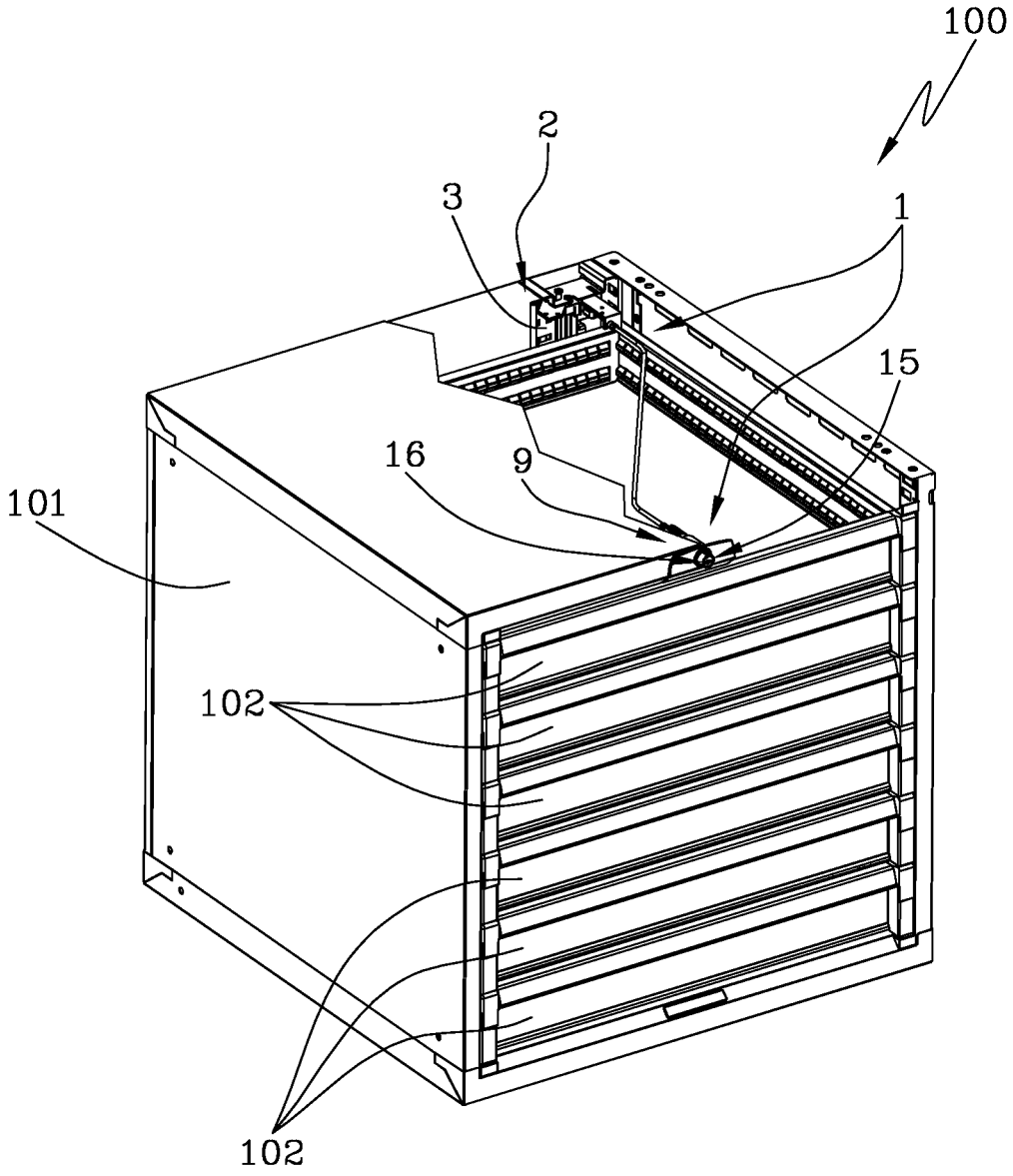
FIG. 1 is a partially sectioned view of a drawer cabinet provided with a closure system according to the present invention and in accordance with a first embodiment.

With reference to the attached figures, a drawer cabinet of the type comprising a supporting structure 101 provided with a plurality of drawers 102 that are stacked vertically with respect to each other 100, is indicated in its entirety by the number 100.

Within the scope of the present invention, the term "drawer cabinet" is intended as any structure (cabinet, frame, shelving, etc.) provided with drawers with any layout (drawers may be arranged horizontally or vertically, and slide horizontally). Moreover, this term encompasses technical solutions with exposed drawer fronts or drawers enclosed by one or more hinged doors, or other solutions as well.

The drawers 102 are slidably applied along respective guides 103 that define respective horizontal sliding paths.

The cabinet 100 further comprises a closure system 1 designed for enabling or preventing the opening of one drawer 102 at a time. In further detail, the closure system 1 permits the following configurations to be achieved:

- a first configuration suited to enabling the opening of one drawer 102 at a time (regardless of which drawer is actually opened); and a second configuration suited to preventing the opening of each drawer 102, thus implementing complete closure of the cabinet 100.

The closure system 1 according to the invention can be realized according to different embodiments, all of which sharing one inventive idea. These embodiments are described in detail below; however, first the characteristics common to all the different embodiments will be described.

To realize the above-mentioned configurations, the closure system 1 comprises locking means 2 that can be configured in at least a releasing position, in which the locking means 2 enables the opening of a drawer 102, and a locking position, in which it prevents the opening of the drawers 102.

In further detail, the locking means 2 comprises a vertical supporting rod 3 applied to the supporting structure 101, preferably in a bottom portion thereof, and a succession of cam elements 4 slidably arranged on the supporting rod 3 in a stacked configuration, as shown in FIGS. 2-6 (in some solutions, for example with the drawers oriented vertically, the supporting rod on which the cam elements slide can be horizontally oriented).

The locking means 2 further comprises, for each drawer 102, at least one movement pin 5 suitable for engaging with at least one of the cam elements 4 during opening and closing movement of the drawer 102, so as to realize the lifting (FIG. 3) or lowering of the cam element 4 and of the cam elements 4 above. Within this operating framework, the term "cam element" encompasses any element that is slidably insertable inside the vertical rod 3 and suitable for receiving lifting or lowering movement following forward or backward movement of the movement pin 5 (which moves perpendicularly to the lifting/lowering direction of the cam elements 4).

Figure 4:
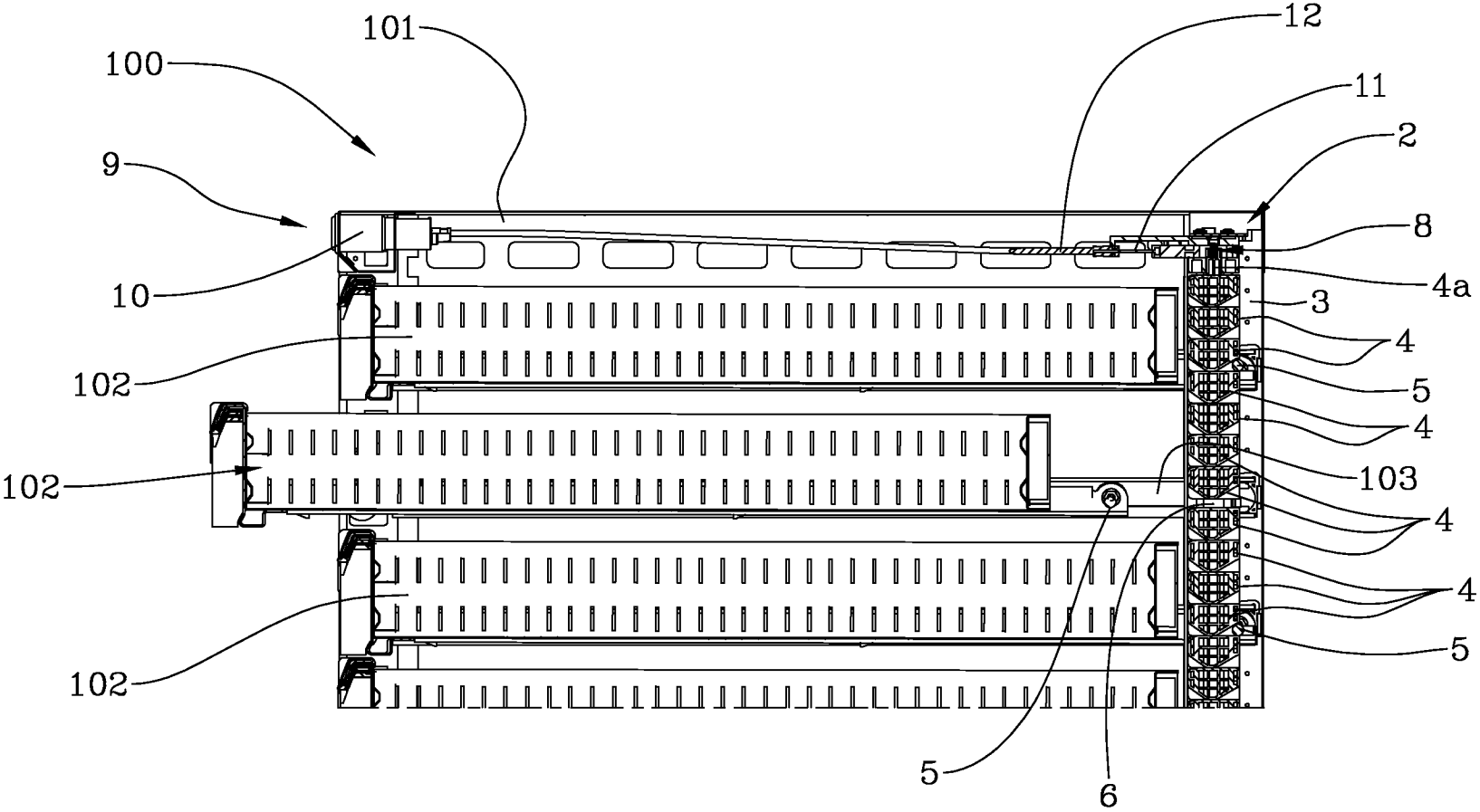
Figure 5:
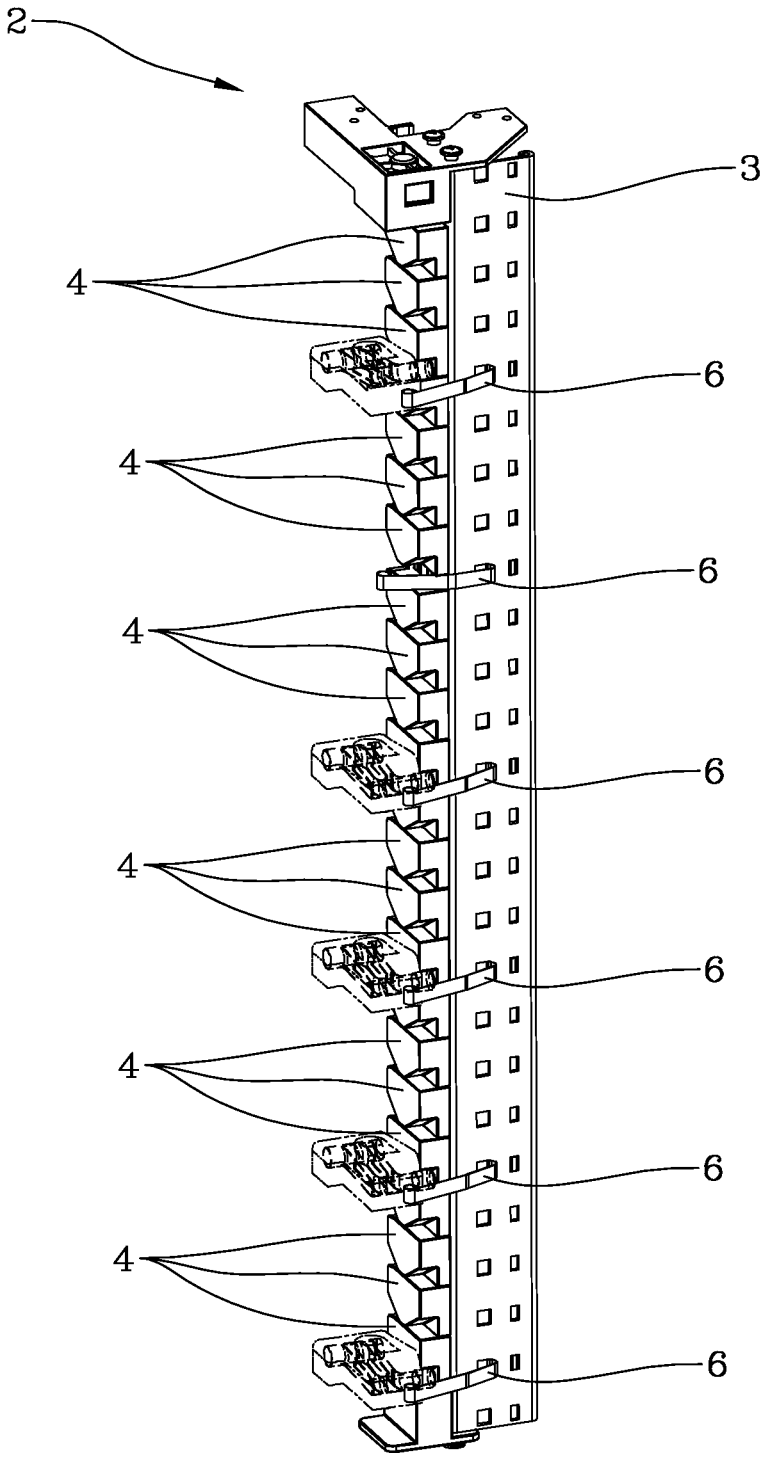
FIGS. 5 and 6 show part of the closure system illustrated in FIG. 1, as observed from different angles.
Figure 6:
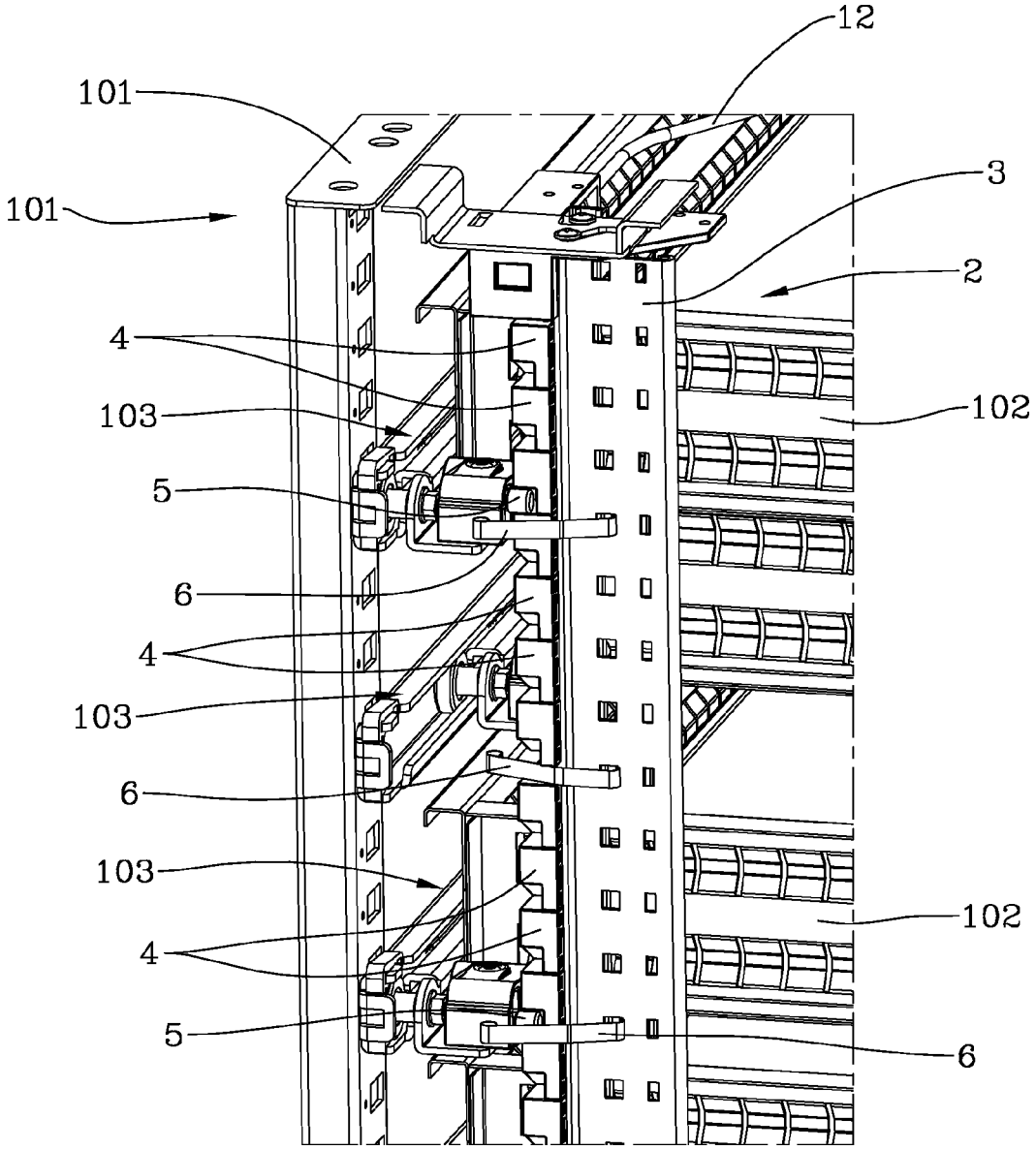

The locking means 2 further comprises, for each drawer 102 (that is, for each movement pin 5) a separator element 6 that is interposed between the two cam elements 4 previously separated by the movement of a movement pin 5, so that subsequent re-lowering of the cam elements 4 is not generated upon the distancing of the movement pin 5 away from the supporting rod 2, but the cam elements 4 lifted by the opening of the drawer 102 remain raised, precisely by interposition of the separator element 6 (as shown in FIG. 4). Preferably, the height of the separator element 6 is slightly lower than the height of the movement pin 5.

Figure 7:
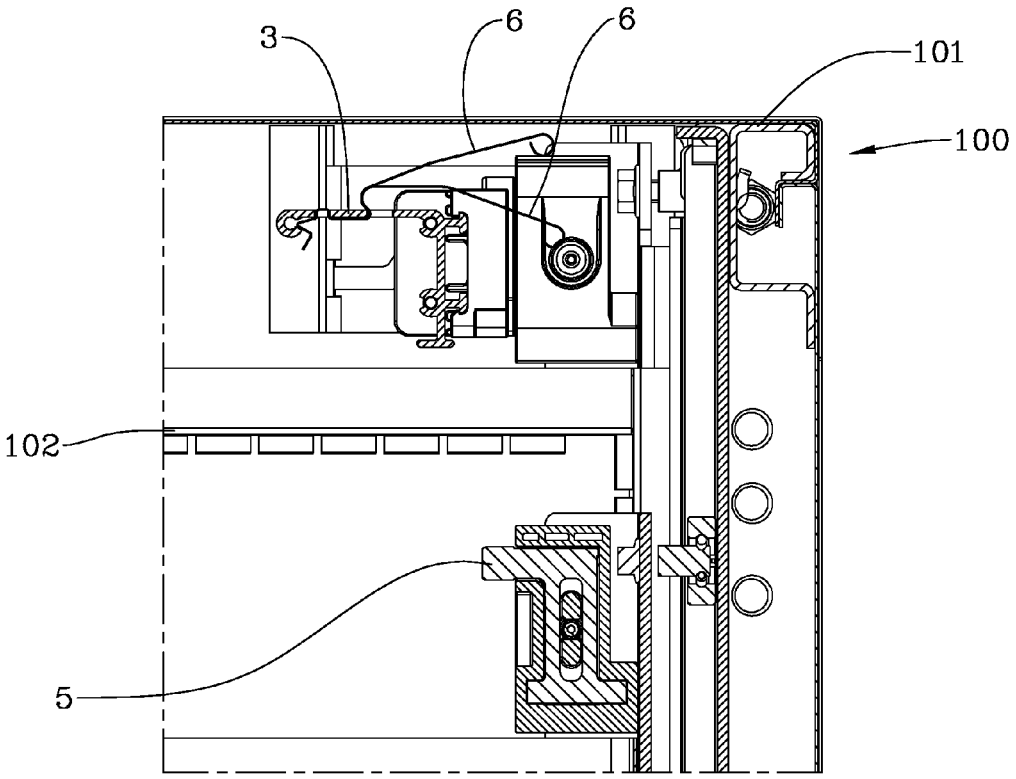
FIG. 7 is a sectional view of the drawer cabinet in FIG. 1, on a horizontal plane chosen so as to illustrate several components in particular.

In the specific embodiment described and illustrated, the separator element 6 is defined by a flexible, elastic tongue, which is pushed back when the respective drawer 102 in is the closed position, whereas it is brought (by springback action) between the two cam elements 4 separated by the movement pin 5 of the drawer 102 following the opening of the drawer 102. The separator element 6 is clearly illustrated in FIGS. 5-9 (the two limit positions that can be reached by the separator element 6 are both illustrated together in FIG. 7 on two different levels).

Within the scope of the present invention, however, the separator elements 6 could be realized in other forms, for example by means of special appendages afforded on rotating cam elements or in accordance with even other different forms.

The locking means 2 further comprises a translatory motion device 7 that is movable between the above-mentioned locking and releasing positions in such a manner that in the locked configuration, the translatory motion device 7 defines an upper abutment element for the stacked cam elements 4, preventing a complete lifting movement (that is, a movement sufficient for the passage of a movement pin 5) of the cam elements 4 and thus movement for opening a drawer 102. In other words, in the locked position, the translatory motion device 7 can be interposed between the top cam element 4 (or an auxiliary element 4*a* applied thereto or integral therewith, as can be seen in FIG. 2) and an upper abutment surface that is fixed with respect to the supporting structure 101.

Figure 8:
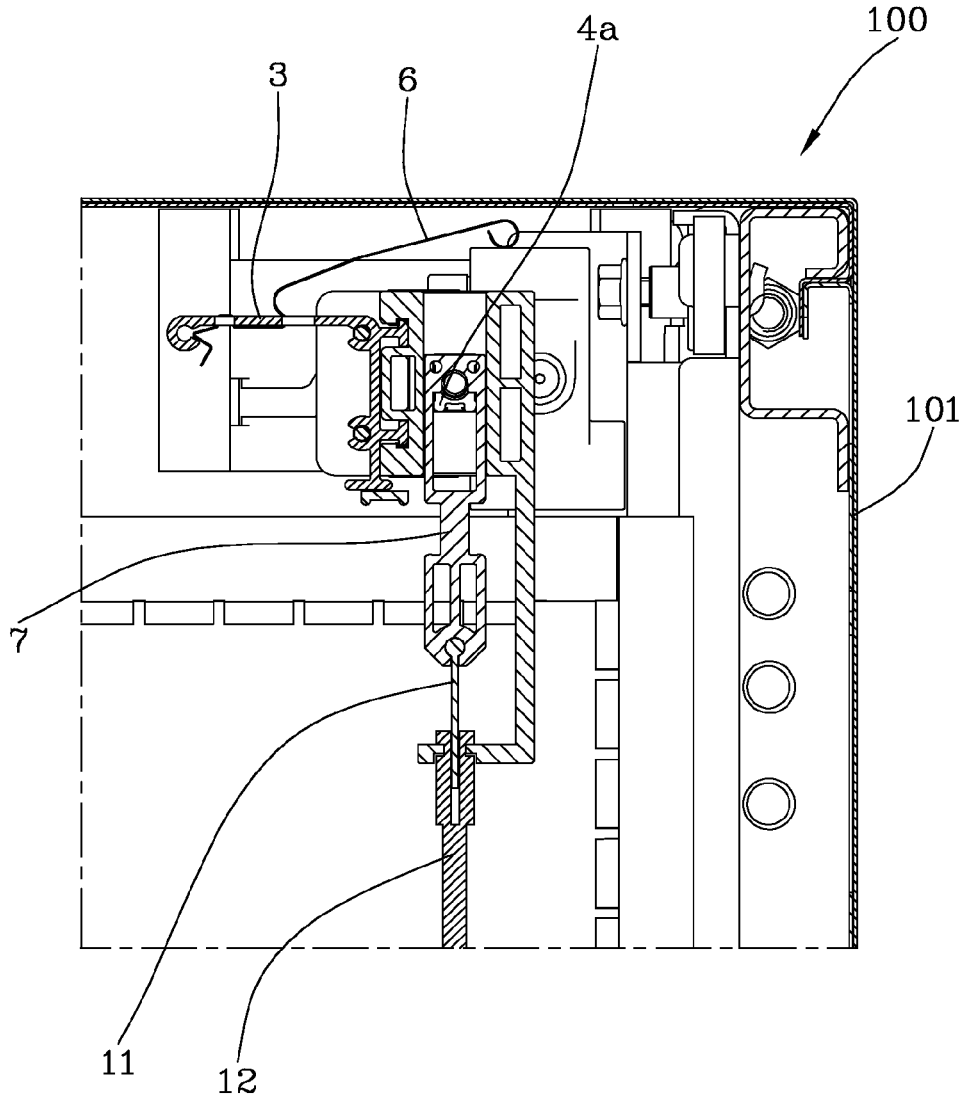
FIGS. 8 and 9 are sectional views of the drawer cabinet in FIG. 1, on a different horizontal plane and in accordance with two successive operating positions, the locking position and the releasing position, respectively.
Figure 9:
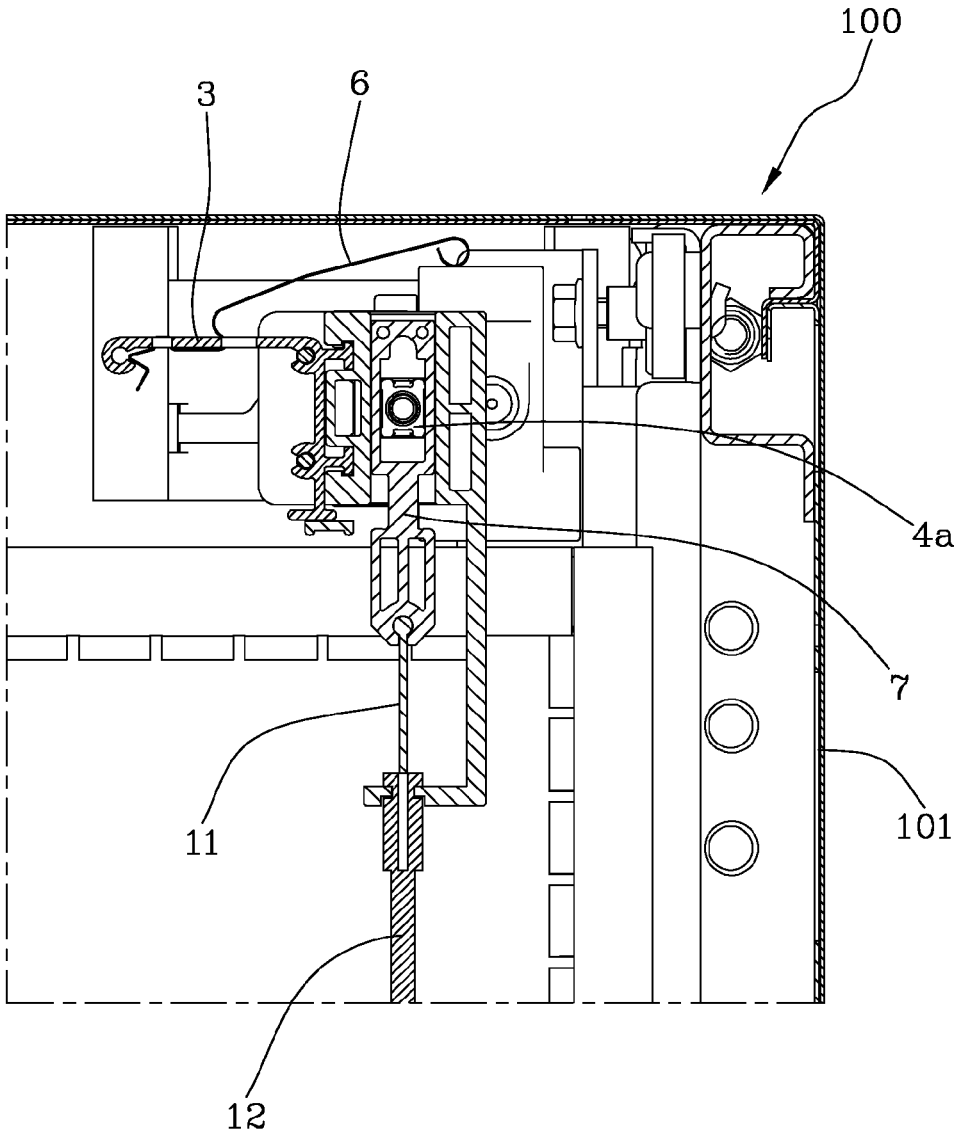
Figure 10B:
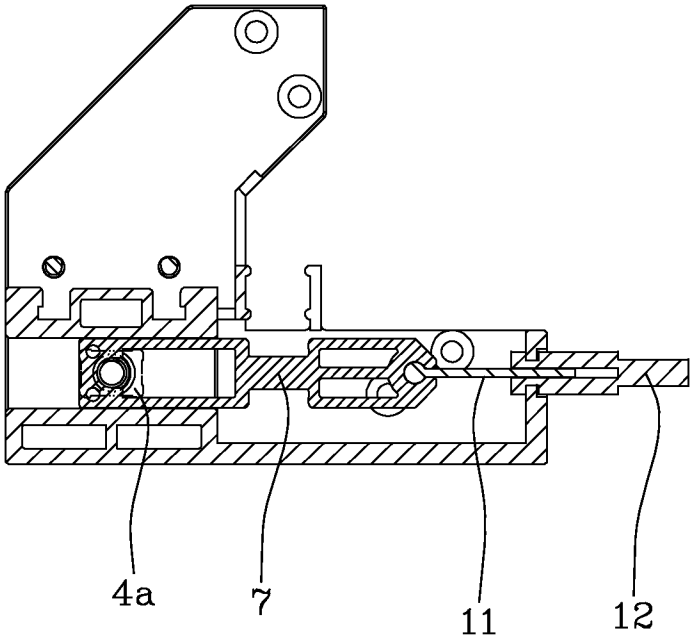
FIGS. 10B and 11B are sectional views, on a horizontal plane, of the part of the closure system in FIGS. 10A and 11A, respectively.
Figure 10A:
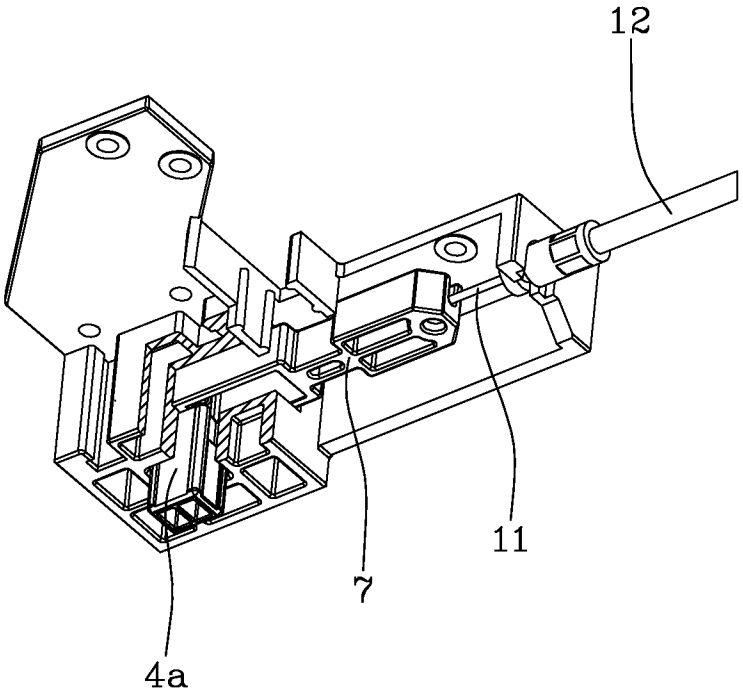
FIGS. 10A and 11A are two views of part of the closure system illustrated in FIG. 1, in two successive operating positions, the locking position and the releasing position, respectively.
Figure 11B:
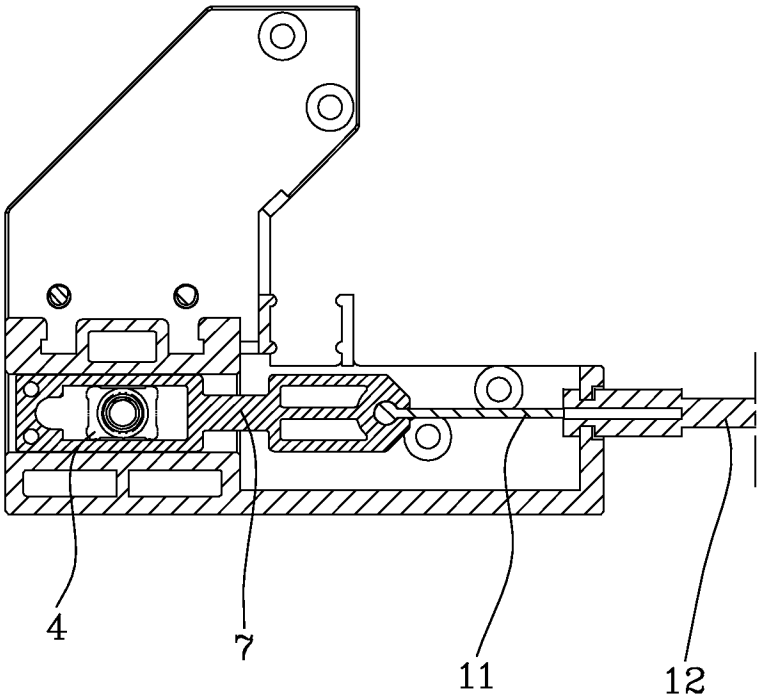
Figure 11A:
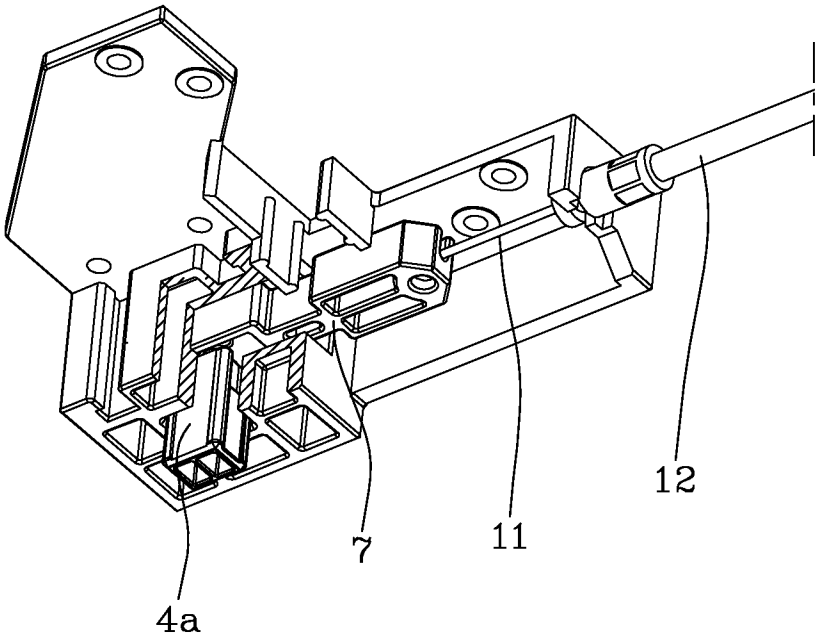

The locked position of the translatory motion device 7 is illustrated in FIGS. 8, 10A and 10B and the released position is shown in FIGS. 9, 11A and 11B.

Figure 2:
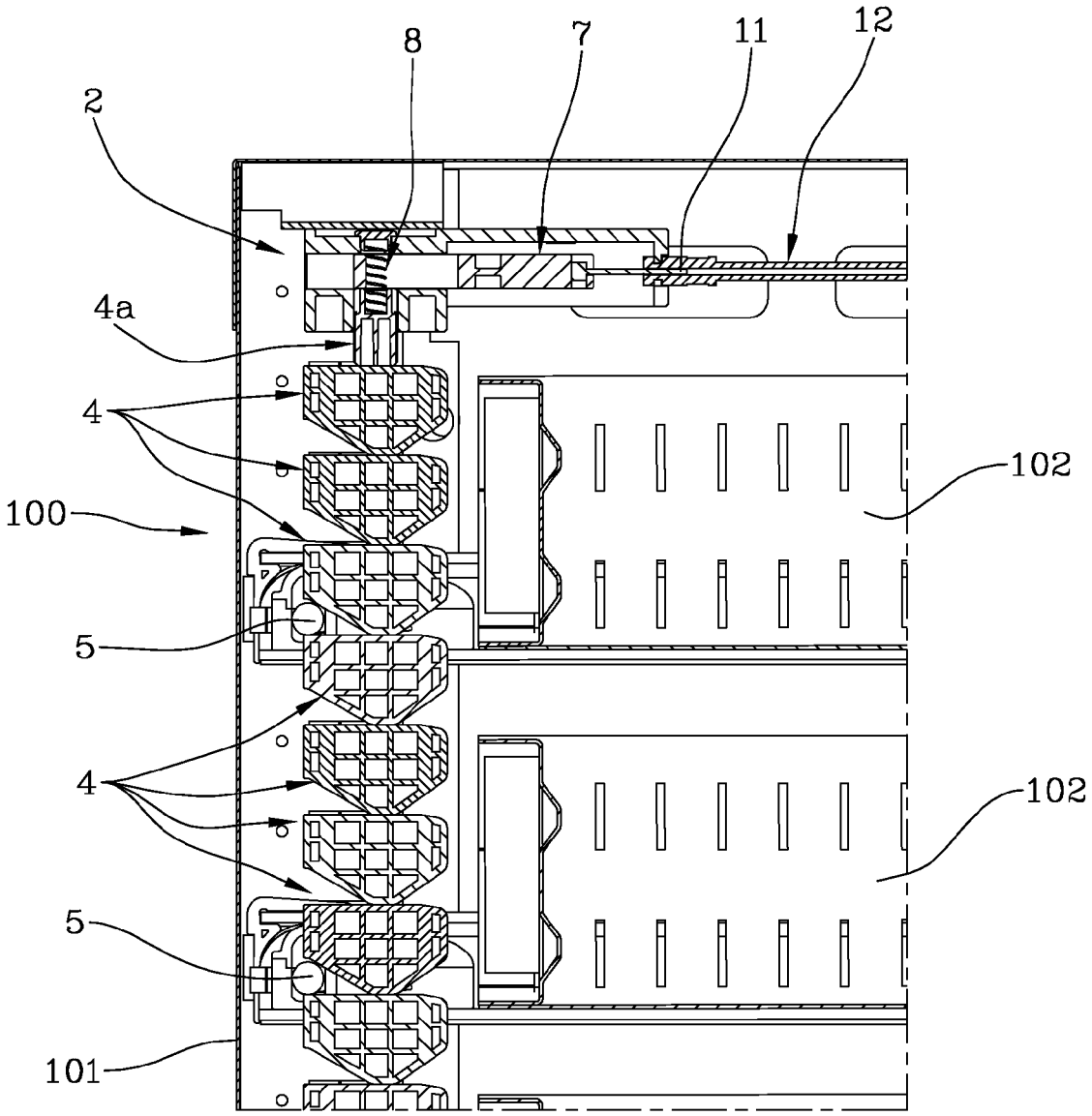
FIGS. 2-4 are sectional views, on a vertical plane, of a portion of the drawer cabinet in FIG. 1, in three different operating positions.
Figure 3:
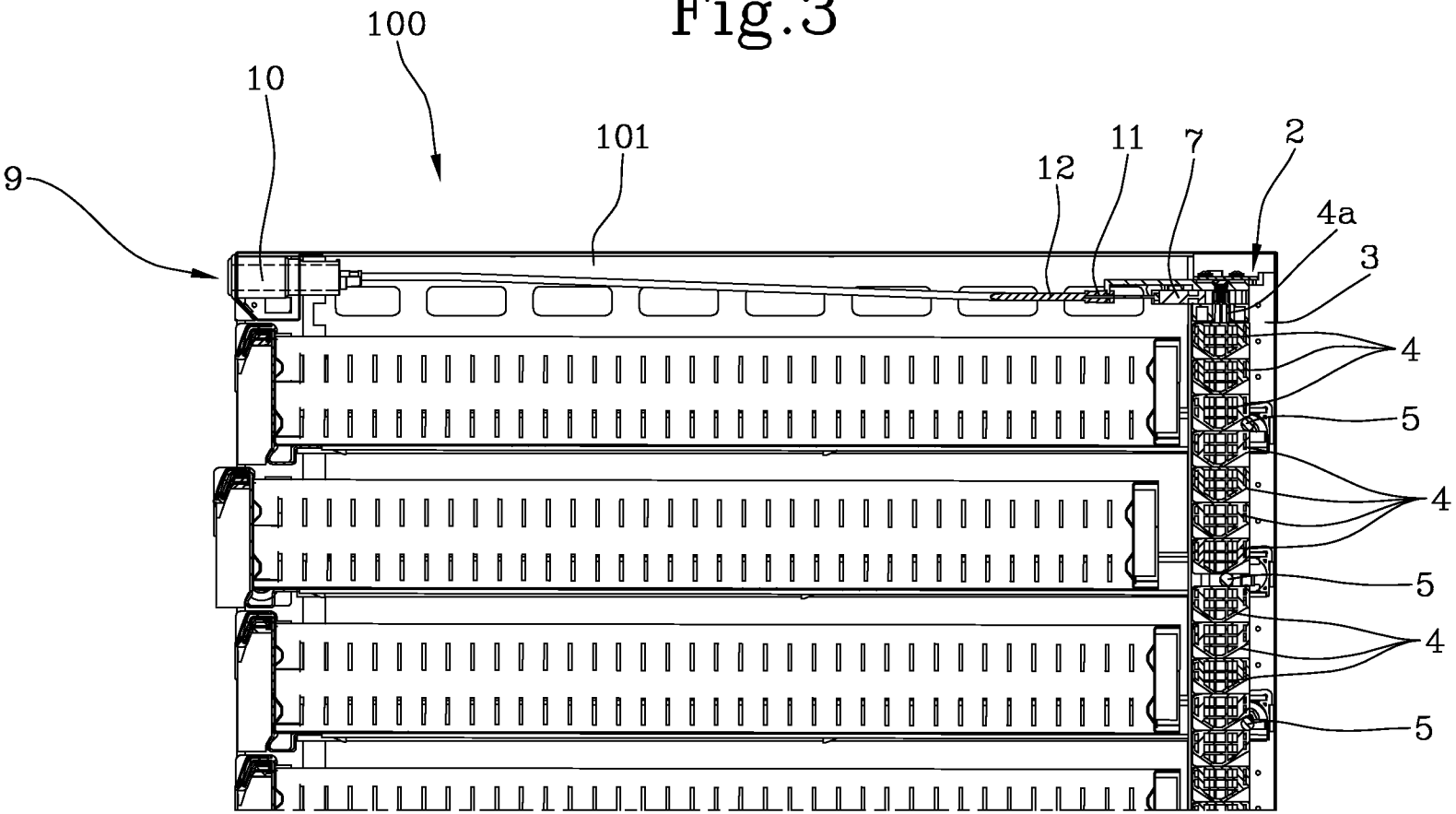

For the purpose of facilitating a lowering push on the cam elements 4, with the aim of reciprocally pressing one against the other, a contrast spring 8, as can be seen in FIG. 2 for example, can be provided. This contrast spring 8 acts upon the auxiliary element 4*a*, which, as shown in FIG. 2, functions as a socket for containing the lower portion of the spring 8.

The direction of the translatory motion of the translatory motion device 7 is horizontal and thus perpendicular to the lifting and lowering direction of the cam elements 4.

The closure system 1 further comprises activation means 9 that can be activated by means of the command of an operator and the activation means 9 is active on the locking means 2 for switching (or more in general, for moving) the locking means 2 between the locking and releasing positions.

The activation means 9 is configured so as to take on an open position, corresponding to the releasing position for releasing the locking means 2, and a closed position corresponding to the locking position for locking the locking means 2. In other words, the activation means 9 constitutes the means upon which the operator actually acts so as to give a lock/release command to the locking means 2 (or at least to give a release command).

The closure system 1 according to the invention further comprises enabling means 15 designed for enabling and disabling movement of the locking means 2 between the above-mentioned locking and releasing positions. In other words, the enabling means 15 manages the actual authorization for the operator to activate the locking and releasing of the locking means 2 (this activation would be carried out by the operator precisely by using the activation means 9). In fact, the possibility of an unauthorized operator releasing the locking means 2 is thus prevented.

Advantageously, the activation means 9 is configured in such a manner as to bring itself automatically from the open position to the closed position within a pre-established interval of time, following release of the command for opening the activation means 9 by the operator.

Preferably, this automatic switching of the activation means 9 to the closed position takes place regardless of the status of the enabling means 15. Therefore, even when an opening authorization still remains, the activation means 9 would in any case return to the closed position automatically, following a pre-established interval of time after the release of said command.

FIRST EMBODIMENT

In the first embodiment illustrated in FIGS. 1-12, the activation means 9 comprises:

- a button 10, mechanically acting upon the translatory motion device 7 by means of a flexible cable 11 slidably inserted in a sheath 12, and movable by means of translatory motion between the open and closed positions so that translatory motion of the button 10 slidingly drags the translatory motion device 7, and
- a contrast spring 13 (FIG. 12) designed for keeping the button 10 pushed towards the closed position.

Preferably, the open position corresponds to the pressed position of the button 10, whereas the closed position corresponds to the pulled-out position of the button 10.

In this first embodiment, the enabling means 15 comprises a key lock 16 that has a translatable cylinder 17, which forms part of the above-mentioned button 10, which is thus supplied with a keyhole (observable in FIG. 1) for insertion of a key (unillustrated). The lock 16 is preferably configured as described below.

In further detail, the lock 16 is configured in such a manner as to allow for the following positions:

- a first position, with the cylinder 17 extracted and not rotated, for enabling the translatory motion of the button 10, so as to implement, after the button 10 is pressed, the release of the locking means 2 (thereby obtaining a configuration in which the button 10 is pressed and the cylinder 17 is not rotated);
- a second position, with the cylinder 17 in the extracted and rotated position, for preventing the translatory motion of the button 10 so as to prevent possible pressing of the button 10 and thus the release of the locking means 2 and thus also the opening of any drawer 102.

Advantageously, the rotated position of the lock 16 is not possible with the button 10 in the open position. In other words, the lock 16 is configured in such a manner that with the button 10 pressed, the key cannot be turned to lock the button 10 in the pressed position. Therefore, the lock 16 does enable permanent (unlimited) access for an operator, but rather, it enables access only for the time period during which the operator (who must therefore be present in order to open it) keeps the button 10 pressed with one finger.

Figure 12:
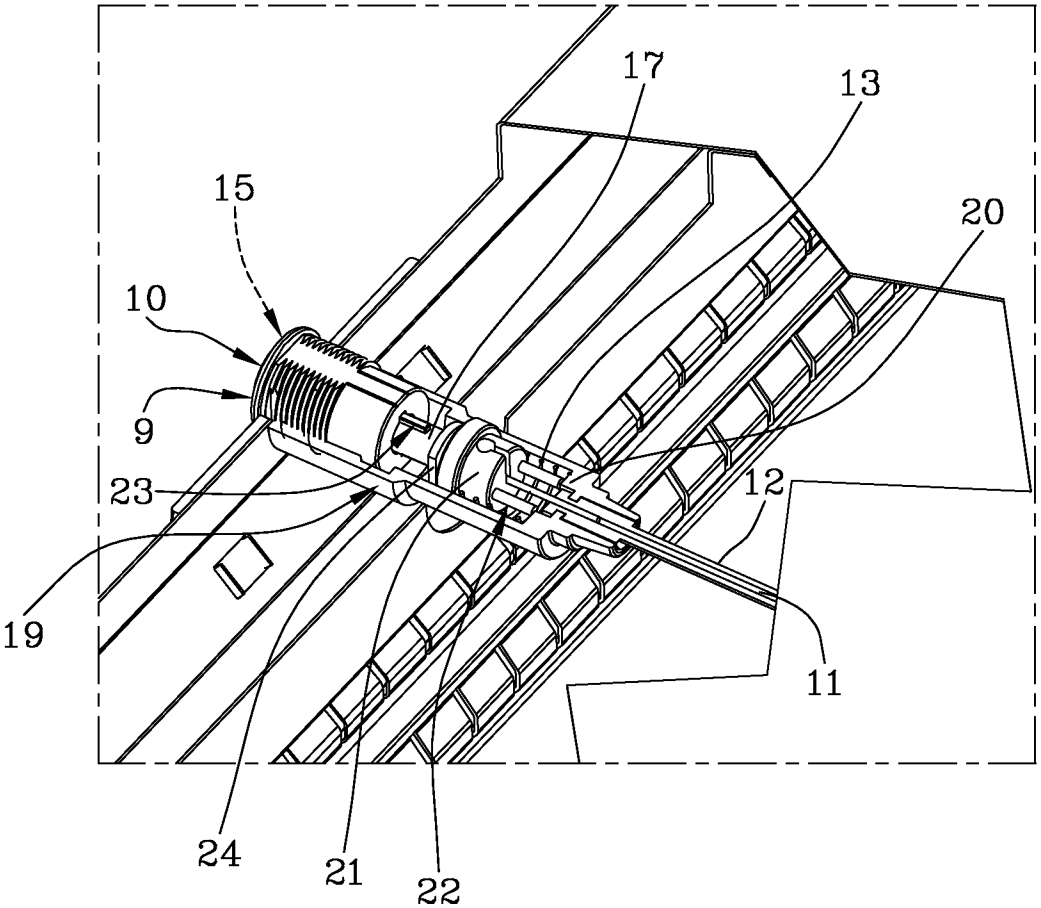
FIG. 12 is a partially sectioned view of a further component of the closure system implemented in the cabinet in FIG. 1.
Figure 13B:
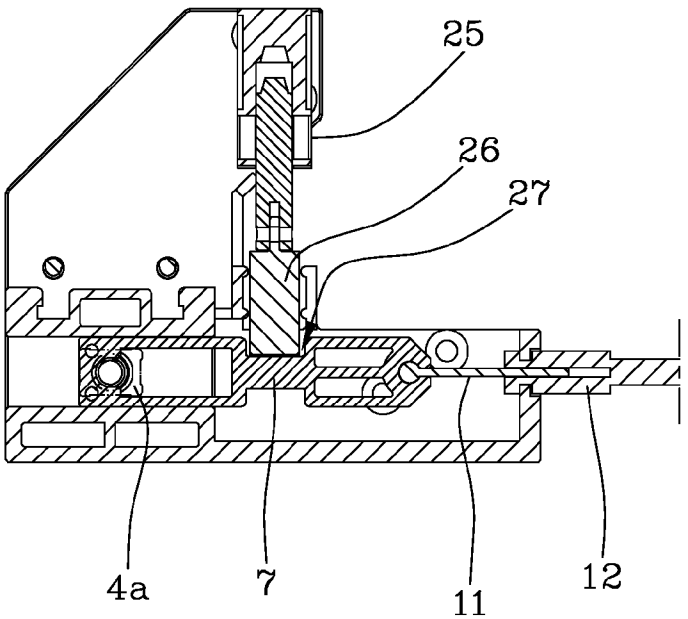
FIGS. 13B and 14B are sectional views, on a horizontal plane, of the part of the closure system in FIGS. 13A and 14A, respectively.
Figure 13A:
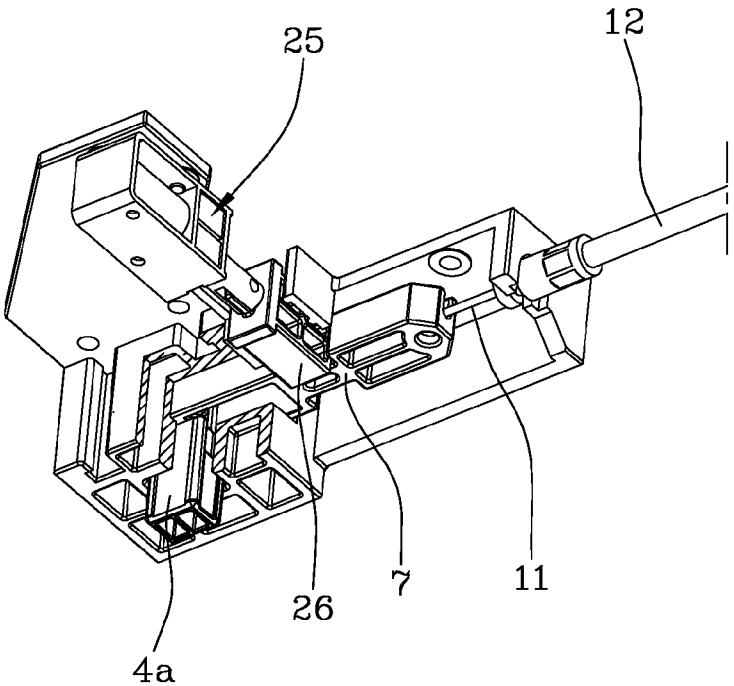
FIGS. 13A and 14A are two views of a part of the closure system illustrated in FIG. 1 in accordance with a second embodiment and in two successive operating positions for preventing and enabling the release thereof, respectively.
Figure 14B:
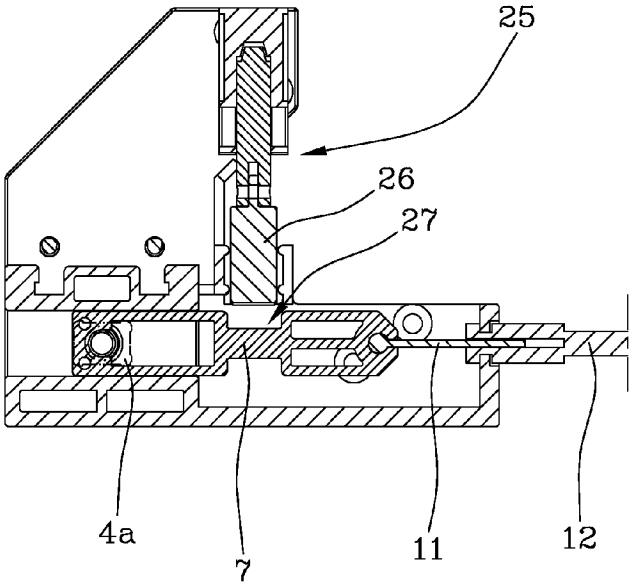
Figure 14A:
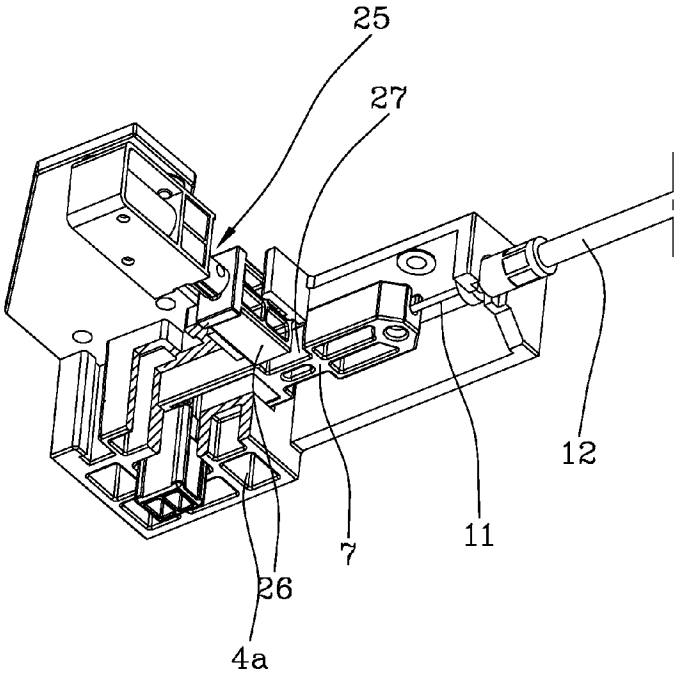
Figure 15:
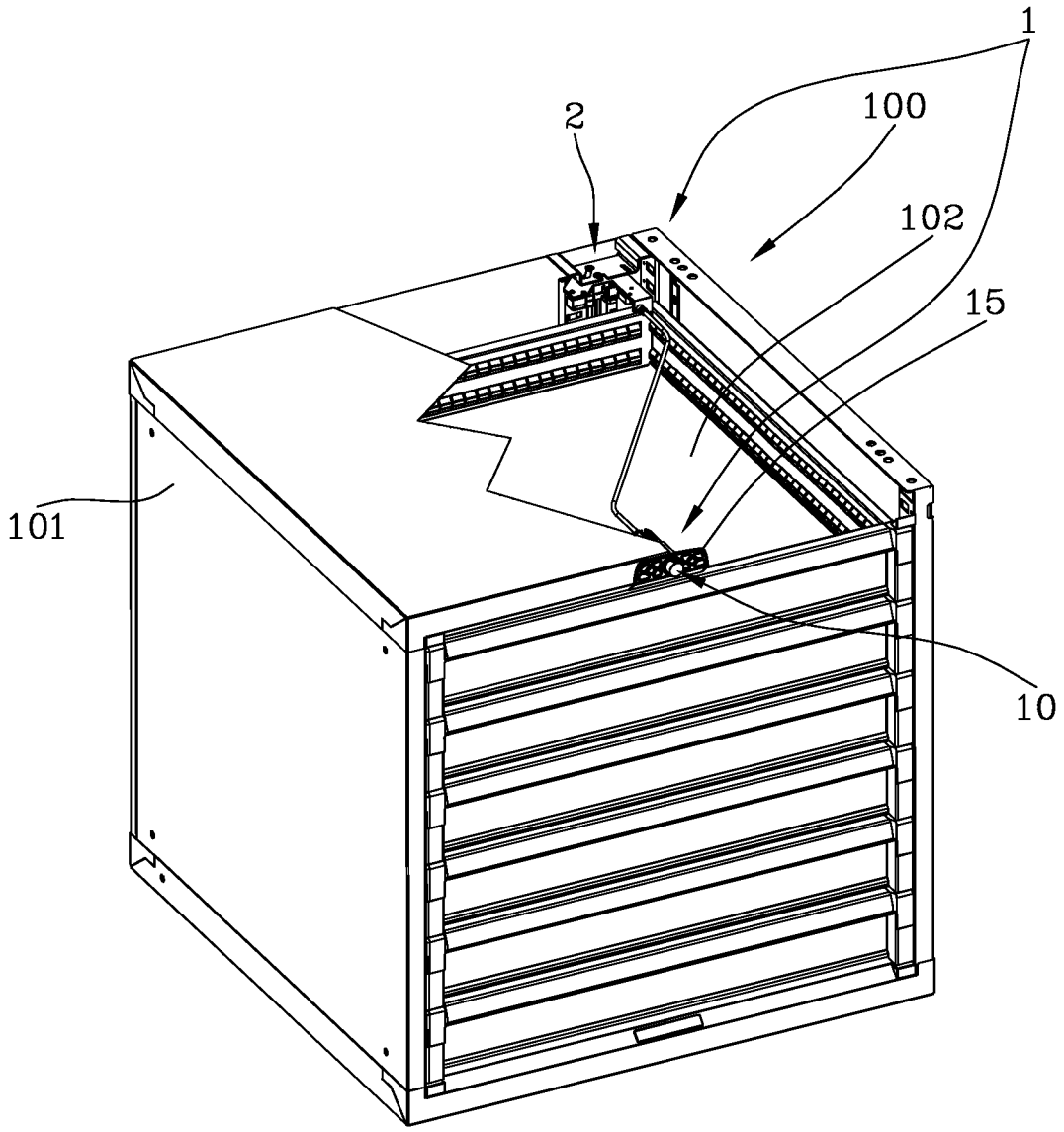
FIG. 15 is a partially sectioned view of a drawer cabinet provided with a closure system according to the present invention and in accordance with the second embodiment in FIGS. 13A, 13B, 14A and 14B.
Figure 16B:
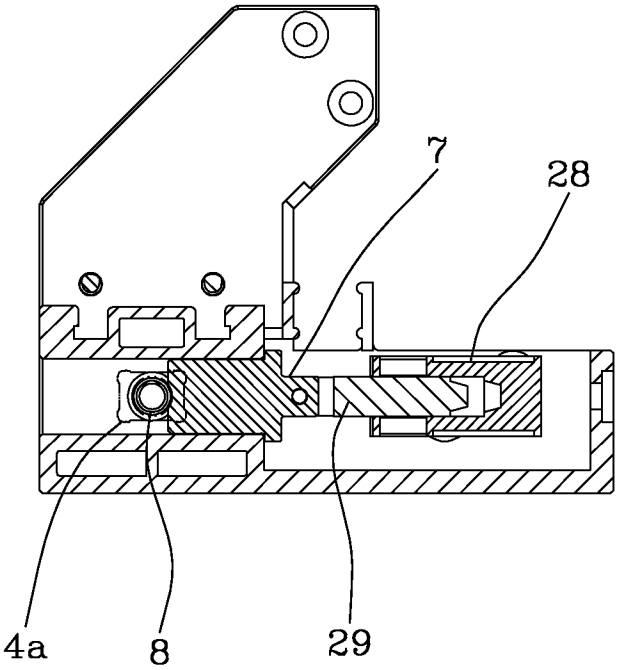
FIGS. 16B and 17B are sectional views, on a horizontal plane of the part of the closure system in FIGS. 16A and 17A, respectively.
Figure 16A:
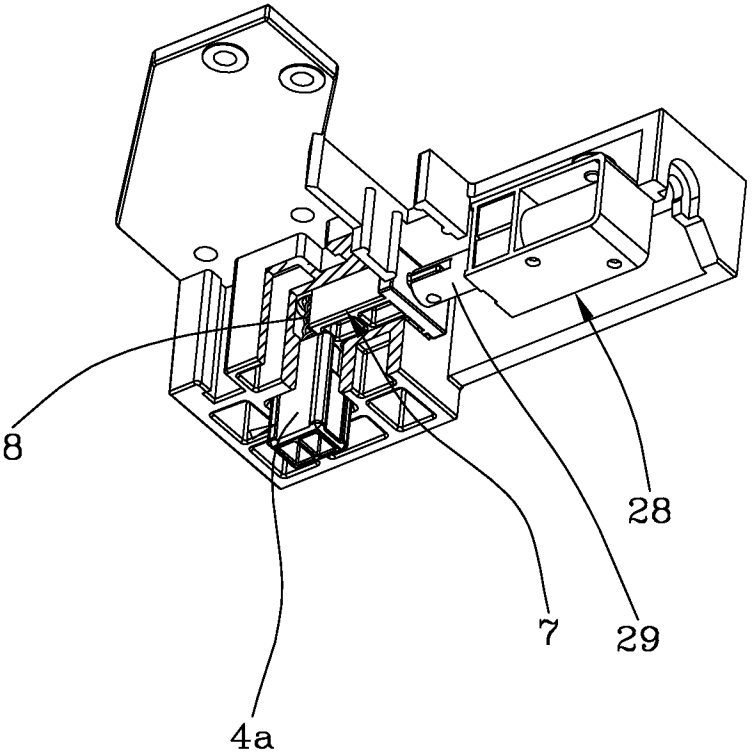
FIGS. 16A and 17A are two views of part of the closure system illustrated in FIG. 1 in accordance with a third embodiment and in two successive operating positions, the locking position and the releasing position, respectively.
Figure 17B:
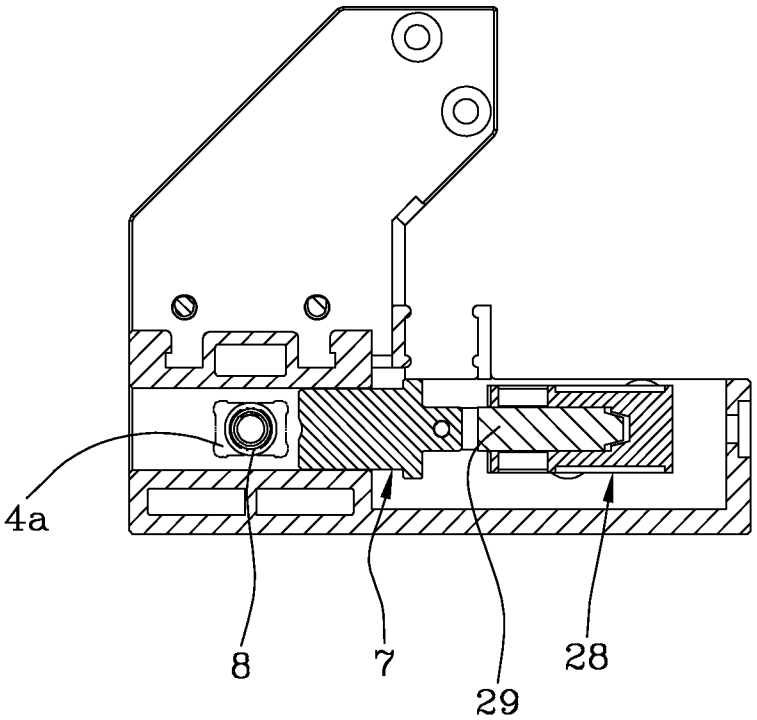
Figure 17A:
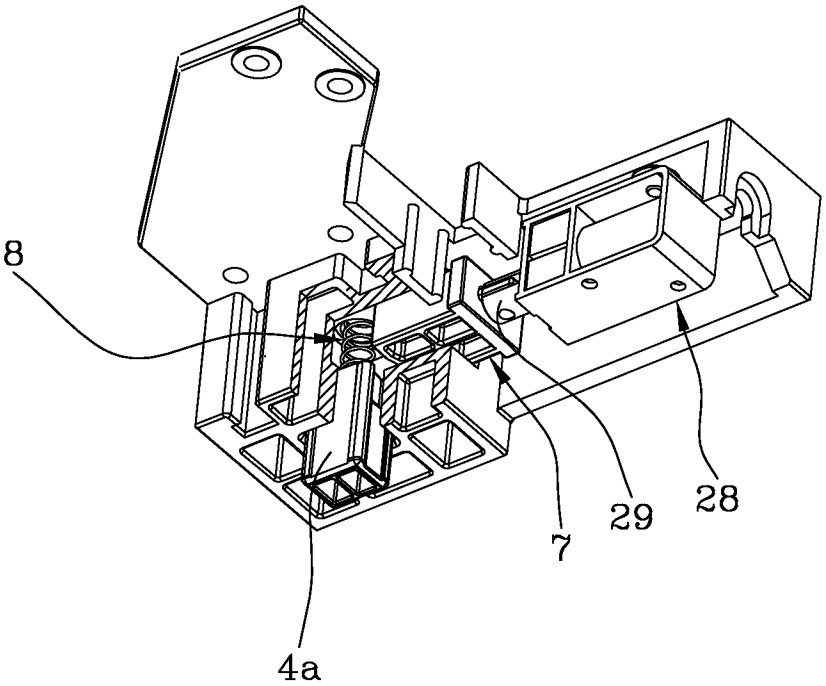

With the aim of realizing this operation of the lock 16, the latter is configured as shown in FIG. 12. Specifically, the lock 16 is inserted in a cylindrical sleeve 19 (for example, by screwing it into a front portion of the sleeve 19), in which a slider 21 is slidably inserted between the lock 16 and a bottom wall 20 of the sleeve 19. The slider 21 is mechanically and bidirectionally connected to the translatory motion device 7 by means of the cable 11, and a front portion of the button 10 (the front portion being identified by a flat pusher 24) is engaged to the slider 21 solely by resting against it.

The contrast spring 13 is directly active on the slider 21 and it keeps the slider 21 pressed against the cylinder 17 of the lock 16. Therefore, when the button 10 is pressed, and the cylinder 17 is not rotated, the button 10 (cylinder 17) advances and thus also the slider 21, with activation of the translatory motion device 7.

The activation means 9 advantageously further comprises spacer means 22 designed for determining a position of maximum translatory motion of the cylinder 17 of the lock 16 by abutment of the slider 21 against the bottom wall 20 of the sleeve 19. This position of maximum translatory motion of the cylinder 17 of the lock 16 defines the open position of the activation means 9 and it is set back with respect to a normal limit position for insertion of the cylinder 17 of the lock 16, which would be achieved by pushing the cylinder 17 of the lock 16 until special raised elements 23 emerge on the bottom of the lock 16, enabling rotation of the cylinder 17.

This hypothetical rotation, which would lead to locking the cylinder 17 in a rotated position (following this rotation, the raised elements 23 would be constrained beyond the rear wall of the lock, making a return of the cylinder back into the starting position impossible), is prevented in the solution according to the invention, owing particularly to the use of the spacer means, which do not allow for a complete translatory movement of the cylinder 17 of the lock, thus preventing permanent activation of the release of the locking means 2.

In the illustrated embodiment, the spacer means 22 comprises one or more pins stably applied to the slider 21 or to the bottom wall 20 of the sleeve 19.

In the first embodiment described above, the above-mentioned pre-established interval of time required for the activation means 9 to return automatically from the open position to the closed position, corresponds to the time required for the button 10 to bring itself from the open position (pressed) to the closed position under the effect of a specific contrast spring (which, though not illustrated, could be a coil spring for example) inside the button 10.

In other words, the cited pre-established interval of time begins the instant when the operator releases the button 10 and it ends at the end of the return stroke of the button 10. In this manner, once the locking means 2 has brought itself into the locking position (upon closure of the drawer 102 following release of the button 10 or as an alternative, simultaneously upon release of the button 10 in the event of the drawers 102 already being closed), accidental opening of any drawer 102 proves to be impossible, unless there is a new command by the operator pressing the button 10.

The fact that the activation means 9 is configured in such a manner as to bring itself automatically from the open position to the closed position within a pre-established interval of time following release of the command for opening the activation means 9 by the operator and "regardless of the status of the enabling means", in this case means that even if the key lock were to be left in an unrotated position (enabling opening), the release of the button 10 would in any case lead to the switching of the locking means 2 into the locked mode. Moreover, the same thing happens even if the key is turned, so as to deny opening authorization.

Given that in the releasing position, the translatory motion device 7 could prove to be unable to return automatically into the locking position (in the illustrated embodiment, the translatory motion device 7 has a cavity within which the contrast spring 8 of the cam elements 4 passes and as can be seen in FIGS. 2-4, 8-9 and 11B, the auxiliary element 4*a*, precisely the auxiliary element 4*a*, retains the translatory motion device 7 in the releasing position), release of the button 10 by the operator, with the translatory motion device 7 "locked in the opening position", leads to the return of the button 10 to the initial closed position with detachment of the flat pusher 24 of the cylinder 17 from the slider 21, which instead remains retained by the cable 11 in a position compressing the respective contrast spring 13. Thus, the button 10 returns to the closed position, but the translatory motion device 7 (and the slider 21 with it) remains released.

Following closure of the drawer 102 by the operator, the contrast spring 8 of the cam elements 4 lowers the auxiliary element 4*a*, freeing the return movement of the translatory motion device 7, which, under the effect of the relative contrast spring or of the contrast spring 13, returns to the releasing position, also pushing the slider 21 back through the action of the cable 11. Advantageously, the return of the slider 21 (which follows a snap movement correlated with the instantaneous release of the translatory motion device 7 by the auxiliary element 4*a*) does not trigger any corresponding unexpected snap movement of the button 10, which had duly returned to its initial position immediately following the release thereof by the operator.

In order to re-open a drawer 102 once the locking position has been reached by the translatory motion device 7, the operator must press the button 10 again, subject to enabling by the lock 16 (cylinder 17 not rotated).

SECOND EMBODIMENT

In the second embodiment, which is illustrated in FIGS. 13A-13B, 14A-14B and 15), the element that differs with respect to the first embodiment described above, is constituted by the enabling means 15. The activation means 9 in the second embodiment still comprises the button 10 (as well as the sleeve 19, the slider 21 etc.). However, the enabling means 15 no longer comprises a lock 16, but rather an electromechanical actuator 25 (an electric cylinder or a worm screw actuator, or yet another device) having a locking element 26 that is movable transversely with respect to the translatory motion device 7 between a position of engagement (FIGS. 13A and 13B), in which it is arranged towards the translatory motion device 7 so as to intercept a corresponding part (defined by a seat 27 in the figures attached hereto) of the translatory motion device 7, blocking the sliding of the translatory motion device 7, and a position of disengagement (FIGS. 14A and 14B), in which it is arranged away from the translatory motion device 7 so as to allow the translatory motion device 7 to slide freely.

In the second embodiment, the enabling means 15 preferably further comprises an electronic recognition system that can be activated by a user and that is designed to command, preferably upon command by the user, movement of the electromechanical actuator 25 from the engagement position to the disengagement position and/or vice versa.

Preferably, the cited electronic recognition system comprises a transponder system or a remote control or a numeric or alphanumeric keypad or digital fingerprint recognizer or any other electronic apparatus fit for this purpose.

In use, once access to the activation means (button 10) is enabled by the enabling means 15, with a resulting passage of the electromechanical actuator 25 into the releasing position (locking element 26 disengaged from the seat 27 of the translatory motion device 7), passage of the translatory motion device 7 into the releasing position for releasing a drawer 102 is realized by pressing the button 10. Subsequently, the release of the button 10 by the operator leads to operation that is identical to that previously described for the first embodiment. A distinguishing element with respect to the first embodiment is that in the second embodiment, the button 10 can be pressed as long as the electromechanical actuator 25 is in a position that allows for the button 10 to be pressed, once the electromechanical actuator 25 is brought into the locking position for locking the translatory motion device 7, for example by the operator using the enabling means 15 (for example by entering another code on the alphanumeric keypad, etc.).

In this second embodiment as well, the above-mentioned pre-established interval of time required for the activation means 9 to return automatically from the open position to the closed position, corresponds to the time required for the button 10 to bring itself from the open position (pressed) to the closed position under the effect of a specific contrast spring (which, though not illustrated, could be a coil spring for example) inside the button 10.

In some situations, the actuator 25 may have to intervene (by taking on the closed position) with the drawer 102 open and thus with the locking element 26 out of alignment with respect to the seat 27 of the translatory motion device 7. In these situations, for the purpose of absorbing the delay between the switching of the electromechanical actuator 25 into the closed position and the actual passage of the translatory motion device 7 into the locked position, there can be provided elastic means or an equivalent thereof, designed particularly to keep the locking element 26 pressed against the translatory motion device so as to realize snap-fit engagement within the seat 27 when the locking position for locking the translatory motion device 7 has been reached, that is to say, when the translatory movement of the translatory motion device 7 causes the seat 27 to be arranged in such a position as to receive the front end of the locking element 26. This elastic means could, for example, be realized by providing the locking element 26 with an elastic portion, preferably by means of a coil spring capable of absorbing the difference in stroke of the locking element 26 when the latter is resting on a tract of the translatory motion device 7 unaffected by the seat 27 with respect to the stroke at the seat 27.

THIRD EMBODIMENT

In the third embodiment, which is illustrated in FIGS. 16A-16B and 17A-17B, the element that differs with respect to the second embodiment is constituted by the substitution of the mechanical connection between the button 10 and the translatory motion device 7 with a system for moving the translatory motion device 7 by means of a specific electromechanical actuator 28 (an electric cylinder or a worm screw or a screw/lead screw type actuator or yet another device) having a piston that is directly applied onto the translatory motion device 7 and that is movable integrally with it.

The electromechanical actuator 28 is configured to take on an open position (FIGS. 17A and 17B), corresponding to the releasing position of the translatory motion device 7, and a closed position (FIGS. 16A and 16B), corresponding to the locking position of the translatory motion device 7.

The activation means 9 further comprises an electronic or electromechanical timer device (unillustrated) that is active on the electromechanical actuator 28 so as to bring the electromechanical actuator 28 automatically from the open position previously reached to the closed position after the above-mentioned pre-established time interval.

The activation means 9 further comprises a button (unillustrated and preferably located on a control panel) that is electrically connected to the electromechanical actuator 28 for manual activation of the electromechanical actuator 28.

Moreover, as in the case of the second embodiment, the enabling means 15 in the third embodiment also comprises an electronic recognition system that can be activated by a user and that is designed for commanding the enabling of the connection between the button and the electromechanical actuator 28. The above-mentioned electronic recognition system preferably comprises a transponder system or a remote control or a numeric or alphanumeric keypad or an electric button.

As in the case of the second embodiment, it can occur with this embodiment as well that in some situations the actuator 28 may have to intervene (by taking on the closed position) with the drawer 102 open and thus with the translatory motion device 7 arranged in a position that is not suited to bringing it into the locked position, particularly with the auxiliary element 4*a* inserted in the translatory motion device 7. In these situations, for the purpose of absorbing the delay between the switching of the electromechanical actuator 28 into the closed position and the actual passage of the translatory motion device 7 into the locked position, there, can be provided elastic means or an equivalent thereof, interposed between the translator motion device 7 and the electromechanical actuator 28. The elastic means is designed particularly to keep the translatory motion device 7 pressed so as to realize a snap movement for passage of the actuator 7 into the locking position upon closure of the drawer 102, and where the auxiliary element 4*a* is forced (by the closing of the drawer) to disengage from the translatory motion device 7 under the effect of the respective contrast spring 8. The elastic means could, for example, be realized by providing the electromechanical actuator 28 with an elastic portion, preferably by means of a coil spring or by interposing the coil spring between the translator motion device 7 and the electromechanical actuator 28.

The present invention achieves the proposed aims, overcoming the described drawbacks of the prior art.

In fact, it has been amply described and demonstrated herein that the use of a system for automatic switching of the activation means into a closed position makes it possible to prevent accidental opening of drawers in the case of cabinets mounted on movable carriages on wheels or mounted on vehicles or boats. This automatic closure operates regardless of whether the operator has actually performed the locking procedure manually and resolves eventual errors due to distraction or to forgetfulness of personnel. Furthermore, the closure system according to the invention is of a centralized type, that is to say, it dependent on a sole activation and/or enabling member arranged on the supporting structure (for example on the front and/or on a control panel) without any need to arrange enabling and activation systems on each drawer.

The invention claimed is:

1. A closure system for a drawer cabinet, comprising:

locking means (2) that can be configured in at least a releasing position, wherein it enables the opening of a drawer (102) of a drawer cabinet (100), and a locking position, wherein it prevents the opening of the drawers (102) of the drawer cabinet (100);

activation means (9) that can be activated by means of the command of an operator and that is active on said locking means (2) for moving the locking means (2) between said locking and releasing positions, said activation means (9) being configured so as to take on an open position, corresponding to the releasing position for releasing the locking means (2), and a closed position corresponding to the locking position for locking the locking means (2);

enabling means (15) designed for enabling and disabling movement of the locking means (2) between said locking and releasing positions;

characterized in that said activation means (9) is configured in such a manner as to bring itself automatically from the open position to the closed position within a pre-established time interval, following release of a command for opening the activation means (9) by the operator regardless of the status of the enabling means (15).

2. The closure system according to claim 1, wherein said locking means (2) comprises a translatory motion device (7) that is active between said locking and releasing positions, and wherein said activation means (9) comprises:

a button (10), mechanically acting upon said translatory motion device (7) and movable by means of translatory motion between said open and closed positions so that translatory motion of the button (10) slidingly drags the translatory motion device (7) and a contrast spring associated with the button (10) and designed for keeping the button (10) pushed towards the closed position, said pre-established time interval corresponding to the time needed for the button (10) to return from the open position to the closed position under the effect of said contrast spring (13).

3. The closure system according to claim 2, wherein said enabling means (15) comprises a key lock (16) with a translatable cylinder (17) and wherein said translatable cylinder (17) defines said button (10); said key lock (16) being configured so as to lock and release manual translatory motion of the button (10) on the part of a user.

4. The closure system according to claim 3, wherein said lock (16) is configured in such a manner as to allow for the following positions:

a first position, with the cylinder (17) extracted and not rotated, for enabling the translatory motion of the button (10);

a second position, with the cylinder (17) extracted and rotated, for preventing the translatory motion of the button (10);

the position being such that rotation of the cylinder (17) is not possible with the button (10) in the pressed position.

5. The closure system according to claim 4, wherein said activation means (9) comprises spacer means (22) designed for determining a position of maximum translatory motion of the cylinder (17) of the lock (16); said position of maximum translatory motion of the cylinder (17) defining said open position and being in advance of a hypothetical limit position of the cylinder (17) suitable for allowing rotation of the key so as to prevent permanent activation of the release of the locking means (2).

6. The closure system according to claim 5, wherein said activation means (9) further comprises a slider (21) that is mechanically and bidirectionally connected to said translatory motion device (7) by means of a connecting cable (11), said slider (21) being slidably inserted within a containing sleeve (19), wherein said button (10) has a front portion (24) engaged to said slider (21), and wherein said spacer means (22) is interposed between said slider (21) and a bottom wall (20) of said sleeve (19) so as to limit a stroke of the slider (21) towards said bottom wall (20) of the sleeve (19).

7. The closure system according to claim 6, wherein said front portion (24) of the cylinder (17) of the lock (16) and said slider (21) are engaged solely by resting one against the other, so as to enable the cylinder (17) to press the slider (21) into a movement for opening the activation means (9) and subsequently to enable the cylinder (17) to return to the closed position regardless of the position of the slider (21).

8. The closure system according to claim 2, wherein said enabling means (9) comprises an electromechanical actuator (25) having a locking element (26) that is movable transversely with respect to the translatory motion device (7) between a position of engagement, wherein it is arranged towards the translatory motion device (7) so as to intercept a corresponding seat (27) of the translatory motion device (7), blocking the sliding of the translatory motion device (7), and a position of disengagement, wherein it is arranged away from the translatory motion device (7) so as to allow the translatory motion device (7) to slide freely.

9. The closure system according to claim 2, wherein said activation means (9) further comprises a slider (21) that is mechanically and bidirectionally connected to said translatory motion device (7) by means of a connecting cable (11), said slider (21) being slidably inserted within a containing sleeve (19), and wherein said button (10) has a front portion (24) engaged with said slider (21), solely by resting thereagainst, so as to enable the button (10) to press the slider (21) into a movement for opening the activation means (9) and subsequently to enable the button (10) to return to the closed position regardless of the position of the slider (21).

10. The closure system according to claim 8, wherein said enabling means (15) further comprises an electronic recognition system that can be activated by a user and that is designed to command, preferably upon command by the user, movement of the electromechanical actuator (25) from the engagement position to the disengagement position and/or vice versa.

11. The closure system according to claim 1, wherein said locking means (2) comprises a translatory motion device (7) that is active between said locking and releasing positions and wherein said activation means (9) comprises:

an electromechanical actuator (28), which is active on the translatory motion device (7) so as to slidingly move the translatory motion device (7) and configured so as to take on an open position, corresponding to the releasing position of the translatory motion device (7), and a closed position corresponding to the locking position of the translatory motion device (7), and a timer device that is active on the electromechanical actuator (28) so as to bring the electromechanical actuator (28) automatically from the open position previously reached by the electromechanical actuator (28) to the respective closed position after said pre-established time interval.

12. The closure system according to claim 11, wherein said activation means (9) further comprises a button for activation of the electromechanical actuator (28) and wherein said enabling means (15) further comprises an electronic recognition system that can be activated by a user and that is designed for commanding the enabling of the command of the electromechanical actuator (28) by the button being pressed.

13. The closure system according to claim 11, wherein said electromechanical actuator comprises a worm screw or a screw/lead screw actuator.

14. The closure system according to claim 11, wherein said locking means (2) comprises a translatory motion device (7) that is active between said locking and releasing positions and wherein an elastic means is interposed between the translatory motion device (7) and the electromechanical actuator (28) so as to enable the translatory motion device (7) and the electromechanical actuator (28) to approach and move away from each other and to keep the translatory motion device (7) pushed towards said locked position while the translatory motion device (7) is in the released position.

15. The closure system according to claim 11, further comprising a contrast spring (13) that is active on the translatory motion device (7) so as to keep the translatory motion device (7) pressed in the closed position, and wherein said activation means (9) is suitable for moving the translatory motion device (7) towards the open position against the action of said contrast spring (13).

16. A drawer cabinet (100) comprising a supporting structure (101) and a plurality of drawers (102) mounted on the supporting structure (101), and further comprising a closure system (1) according to claim 1, and designed to enable, selectively, the opening of one of said drawers (102) at a time, and to realize the simultaneous closure of all of the said drawers (102).

17. The drawer cabinet according to claim 16, wherein said activation means (9) of the closure system (1) is centralized and arranged on a front portion of the supporting structure (101) and/or on a control panel.

18. The drawer cabinet according to claim 16, wherein said locking means (2) comprises:

a vertical supporting rod (3) applied to an internal wall of said supporting structure (101), a succession of cam elements (4) slidably arranged on the supporting rod (3) in a stacked configuration, for each drawer (102), at least one movement pin (5) suitable for engaging with at least one of said cam elements (4) during opening and closing movement of said drawer (102), so as to realize the lifting or lowering of said cam element (4) and of the cam elements (4) above, and a translatory motion device (7) that is movable between said locking and releasing positions in such a manner that in the locked configuration, the translatory motion device (7) defines an upper abutment element for said stacked cam elements (4), preventing a lifting movement of the cam elements (4) that is necessary for the passage of a movement pin (5) between two consecutive cam elements (4) in such a manner as to prevent a drawer (102) from opening.

* * * * *